US008038388B2

(12) United States Patent
Freling et al.

(10) Patent No.: US 8,038,388 B2
(45) Date of Patent: Oct. 18, 2011

(54) ABRADABLE COMPONENT FOR A GAS TURBINE ENGINE

(75) Inventors: Melvin Freling, West Hartford, CT (US); Ken Lagueux, Berlin, CT (US); Christopher W. Strock, Kennebunk, ME (US); Joseph G. Pilecki, Jr., North Berwick, ME (US)

(73) Assignee: United Technologies Corporation, Hartford, CT (US)

( * ) Notice: Subject to any disclaimer, the term of this patent is extended or adjusted under 35 U.S.C. 154(b) by 919 days.

(21) Appl. No.: 11/682,048

(22) Filed: Mar. 5, 2007

(65) Prior Publication Data

US 2008/0219835 A1 Sep. 11, 2008

(51) Int. Cl.
*F01D 11/00* (2006.01)

(52) U.S. Cl. ..... 415/174.4; 415/200

(58) Field of Classification Search ..... 415/174.5, 415/174.4, 199.5, 191, 211.2, 200
See application file for complete search history.

(56) References Cited

U.S. PATENT DOCUMENTS

| | | | | |
|---|---|---|---|---|
| 4,094,673 | A * | 6/1978 | Erickson et al. | 75/246 |
| 4,218,066 | A | 8/1980 | Ackermann | |
| 4,238,170 | A | 12/1980 | Robideau et al. | |
| 4,274,805 | A | 6/1981 | Holmes | |
| 4,311,431 | A * | 1/1982 | Barbeau | 415/173.6 |
| 4,314,173 | A | 2/1982 | Srdoch | |
| 4,386,112 | A | 5/1983 | Eaton et al. | |
| 4,395,195 | A | 7/1983 | De Cosmo et al. | |
| 4,553,901 | A | 11/1985 | Laurello | |
| 4,592,204 | A | 6/1986 | Rice | |
| 4,809,498 | A | 3/1989 | Giffin, III et al. | |
| 4,896,499 | A | 1/1990 | Rice | |
| 4,936,745 | A * | 6/1990 | Vine et al. | 415/173.4 |
| 5,205,115 | A | 4/1993 | Plemmons et al. | |
| 5,219,268 | A | 6/1993 | Johnson | |
| 5,261,228 | A | 11/1993 | Shuba | |
| 5,267,435 | A | 12/1993 | Frenkel et al. | |
| 5,275,532 | A * | 1/1994 | Mazeaud et al. | 415/182.1 |
| 5,282,718 | A | 2/1994 | Koff et al. | |
| 5,307,622 | A | 5/1994 | Ciokajlo et al. | |
| 5,308,225 | A | 5/1994 | Koff et al. | |
| 5,314,304 | A * | 5/1994 | Wiebe | 415/173.4 |
| 5,351,473 | A | 10/1994 | Shuba | |
| 5,361,580 | A * | 11/1994 | Ciokajlo et al. | 60/226.1 |

(Continued)

FOREIGN PATENT DOCUMENTS

EP 0541325 A1 5/1993

(Continued)

OTHER PUBLICATIONS

Extended European Search Report for Application No. EP 08 25 0742, dated Jul. 7, 2008.

*Primary Examiner* — Edward Look
*Assistant Examiner* — Aaron R Eastman
(74) *Attorney, Agent, or Firm* — Carlson, Gaskey & Olds PC

(57) ABSTRACT

A gas turbine engine component includes an airfoil having a radial outward end and a radial inward end. A seal member is positioned adjacent to the radial inward end of the airfoil. A tip of the radial inward end of the airfoil is coated with an abradable material. The seal member is coated with an abrasive material.

20 Claims, 2 Drawing Sheets

U.S. PATENT DOCUMENTS

| | | | | |
|---|---|---|---|---|
| 5,443,590 | A * | 8/1995 | Ciokajlo et al. | 416/128 |
| 5,536,022 | A * | 7/1996 | Sileo et al. | 277/415 |
| 5,562,404 | A | 10/1996 | Koff et al. | |
| 5,704,759 | A | 1/1998 | Draskovich et al. | |
| 5,780,171 | A * | 7/1998 | Nissley et al. | 428/629 |
| 5,950,308 | A | 9/1999 | Koff et al. | |
| 6,089,825 | A * | 7/2000 | Walden et al. | 415/173.4 |
| 6,102,656 | A * | 8/2000 | Nissley et al. | 415/174.4 |
| 6,190,124 | B1 * | 2/2001 | Freling et al. | 415/173.4 |
| 6,267,553 | B1 * | 7/2001 | Burge | 415/115 |
| 6,358,002 | B1 * | 3/2002 | Good et al. | 415/174.4 |
| 6,537,020 | B2 * | 3/2003 | Humhauser | 415/173.1 |
| 6,619,030 | B1 | 9/2003 | Seda et al. | |
| 6,652,227 | B2 * | 11/2003 | Fried | 415/173.4 |
| 6,655,920 | B2 * | 12/2003 | Beutin et al. | 416/198 A |
| 7,241,108 | B2 * | 7/2007 | Lewis | 415/173.4 |
| 7,287,956 | B2 * | 10/2007 | Bracken et al. | 415/173.3 |
| 7,291,946 | B2 * | 11/2007 | Clouse et al. | 310/51 |
| 7,448,843 | B2 * | 11/2008 | Pilecki, Jr. | 415/1 |
| 7,470,113 | B2 * | 12/2008 | Tran et al. | 416/198 A |
| 7,581,920 | B2 * | 9/2009 | Lardellier | 415/1 |
| 2003/0163984 | A1 | 9/2003 | Seda et al. | |
| 2004/0150272 | A1 | 8/2004 | Gordon et al. | |
| 2005/0022501 | A1 | 2/2005 | Eleftheriou et al. | |
| 2005/0109013 | A1 | 5/2005 | Eleftheriou et al. | |
| 2005/0152778 | A1 * | 7/2005 | Lewis | 415/174.4 |
| 2008/0008581 | A1 * | 1/2008 | Pilecki | 415/173.4 |
| 2008/0014077 | A1 * | 1/2008 | Hopkins | 415/174.4 |
| 2008/0044278 | A1 | 2/2008 | Paprotna et al. | |
| 2008/0081172 | A1 * | 4/2008 | Strock | 428/304.4 |
| 2009/0072487 | A1 * | 3/2009 | Chougule et al. | 277/412 |

FOREIGN PATENT DOCUMENTS

| | | | |
|---|---|---|---|
| EP | 0559420 | A1 | 9/1993 |
| EP | 0634569 | B1 | 6/1994 |
| EP | 0631041 | A1 | 12/1994 |
| EP | 0634569 | A1 | 1/1995 |
| EP | 0718469 | A1 | 6/1996 |
| EP | 0541325 | B1 | 5/1997 |
| EP | 0631041 | B1 | 5/1997 |
| EP | 0837222 | A1 | 4/1998 |
| EP | 0718469 | B1 | 10/2001 |
| EP | 1205639 | A1 | 5/2002 |
| EP | 1340902 | A2 | 9/2003 |
| EP | 1555392 | A2 | 7/2005 |
| EP | 1876326 | A2 | 1/2008 |
| EP | 1878876 | A2 | 1/2008 |
| GB | 902645 | | 11/1958 |
| GB | 2207191 | A | 1/1989 |
| GB | 2226050 | A | 6/1990 |
| GB | 2310255 | A | 8/1997 |
| WO | 2005012696 | A1 | 2/2005 |

* cited by examiner

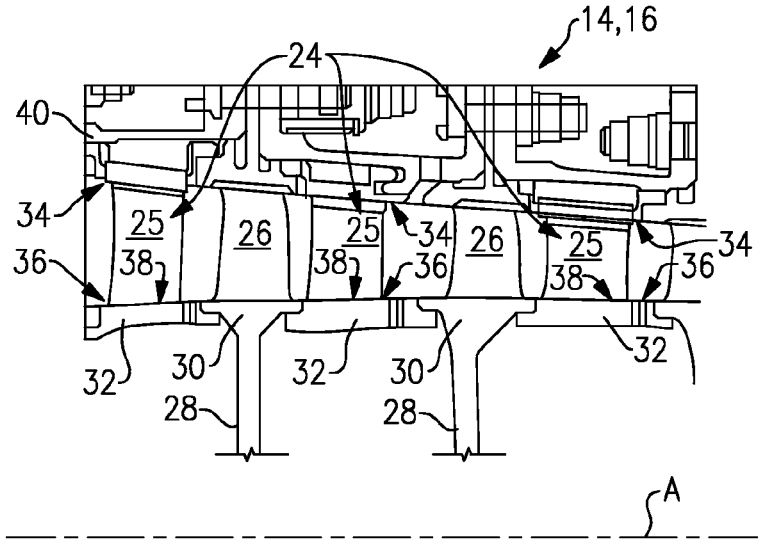
FIG.2
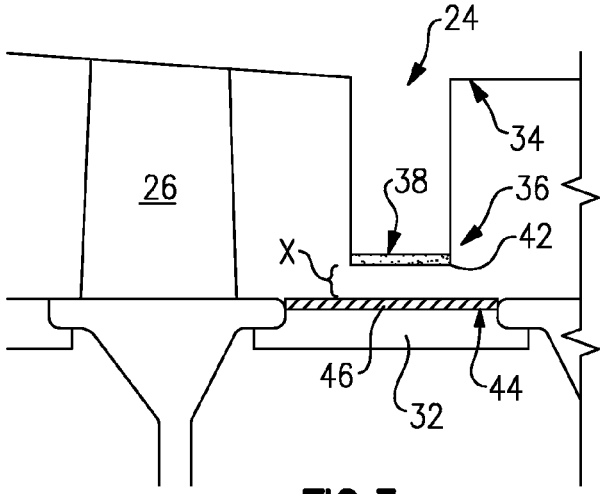
FIG.3
FIG.4
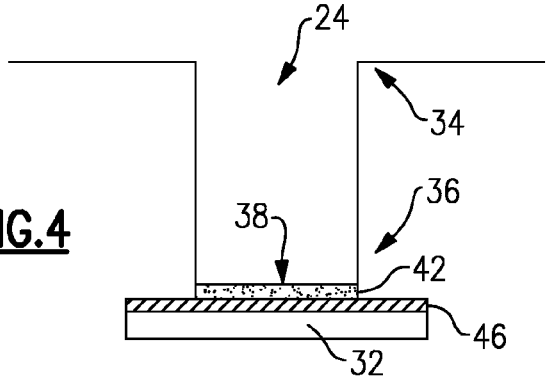

ABRADABLE COMPONENT FOR A GAS TURBINE ENGINE

BACKGROUND OF THE INVENTION

This invention generally relates to a gas turbine engine, and more particularly to an abradable component for a gas turbine engine.

Gas turbine engines typically include a compressor section, a combustor section and a turbine section. Air is pressurized in the compressor section and is mixed with fuel and burned in the combustor section to add energy to expand the air and accelerate the airflow into the turbine section. The hot combustion gases that exit the combustor section flow downstream through the turbine section, which extracts kinetic energy from the expanding gases and converts the energy into shaft horsepower to drive the compressor section.

The compressor section of the gas turbine engine typically includes multiple compression stages to obtain high pressure levels. Each compressor stage consists of a row of stationary airfoils called stator vanes followed by a row of moving airflows called rotor blades. The stator vanes direct incoming airflow for the next set of rotor blades.

Gas turbine engine operation and efficiency is affected by a number of factors which include component design, manufacturing tolerance, engine clearances and rub interactions. Cantilevered compressor stator vanes are known which are attached at their radial outward end (i.e., the stator vanes are mounted at an end adjacent to the engine casing). A radial inward end of each stator is unsupported and is positioned adjacent to a rotor seal land extending between adjacent rotor stages.

Attempts have been made to decrease the amount of clearance between the tips of the cantilevered stator vanes and the rotor seal lands. For example, cantilevered stator vanes are known in which stator tips rub against an abrasive section inlaid in the rotor seal land during initial running of the engine such that the build clearance between the stator vanes and the rotor seal lands are chosen accordingly. Typically, a build clearance of at least approximately 0.005" is established between the two components. Thus, the build clearance is such that the rotor seal lands only contact the tips of the stator vanes during the maximum closure point in the flight cycle (i.e., the point of a flight cycle where the rotor blades and the stator vanes experience maximum growth as a result of thermal expansion). Therefore, during a majority of the flight cycle, airflow escapes between the stator vanes and the rotor seal lands and may recirculate resulting in inefficiency and instability of the gas turbine engine. Further, during the initial running of the engine, excessive rub interaction between the stator vanes and the abrasive section of the rotor seal land may result in vane tip damage, mushrooming, metal transfer to adjacent rotors, and rotor burn through.

Accordingly, it is desirable to provide improved rub interaction between adjacent components of a gas turbine engine having a reduced clearance defined therebetween to improve engine efficiency and stability.

SUMMARY OF THE INVENTION

A gas turbine engine component includes an airfoil having a radial outward end and a radial inward end. A seal member is positioned adjacent to the radial inward end of the airfoil. A tip of the radial inward end of the airfoil is coated with an abradable material. The seal member is coated with an abrasive material.

A gas turbine engine includes an engine casing and a compressor section, a combustor section and a turbine section within the engine casing. At least one of the compressor section and the turbine section includes an airfoil and a seal member adjacent to the airfoil. A tip of the airfoil is coated with an abradable material and the seal member is coated with an abrasive material.

The various features and advantages of this invention will become apparent to those skilled in the art from the following detailed description. The drawings that accompany the detailed description can be briefly described as follows.

BRIEF DESCRIPTION OF THE DRAWINGS

FIG. 2 illustrates a cross-sectional view of a compressor section of a gas turbine engine;

FIG. 3 illustrates a schematic view of a compressor section of a gas turbine engine; and FIG. 4 illustrates a schematic view of an abradable component of the gas turbine engine shown in FIG. 1.

DETAILED DESCRIPTION OF THE PREFERRED EMBODIMENT

Figure 1:
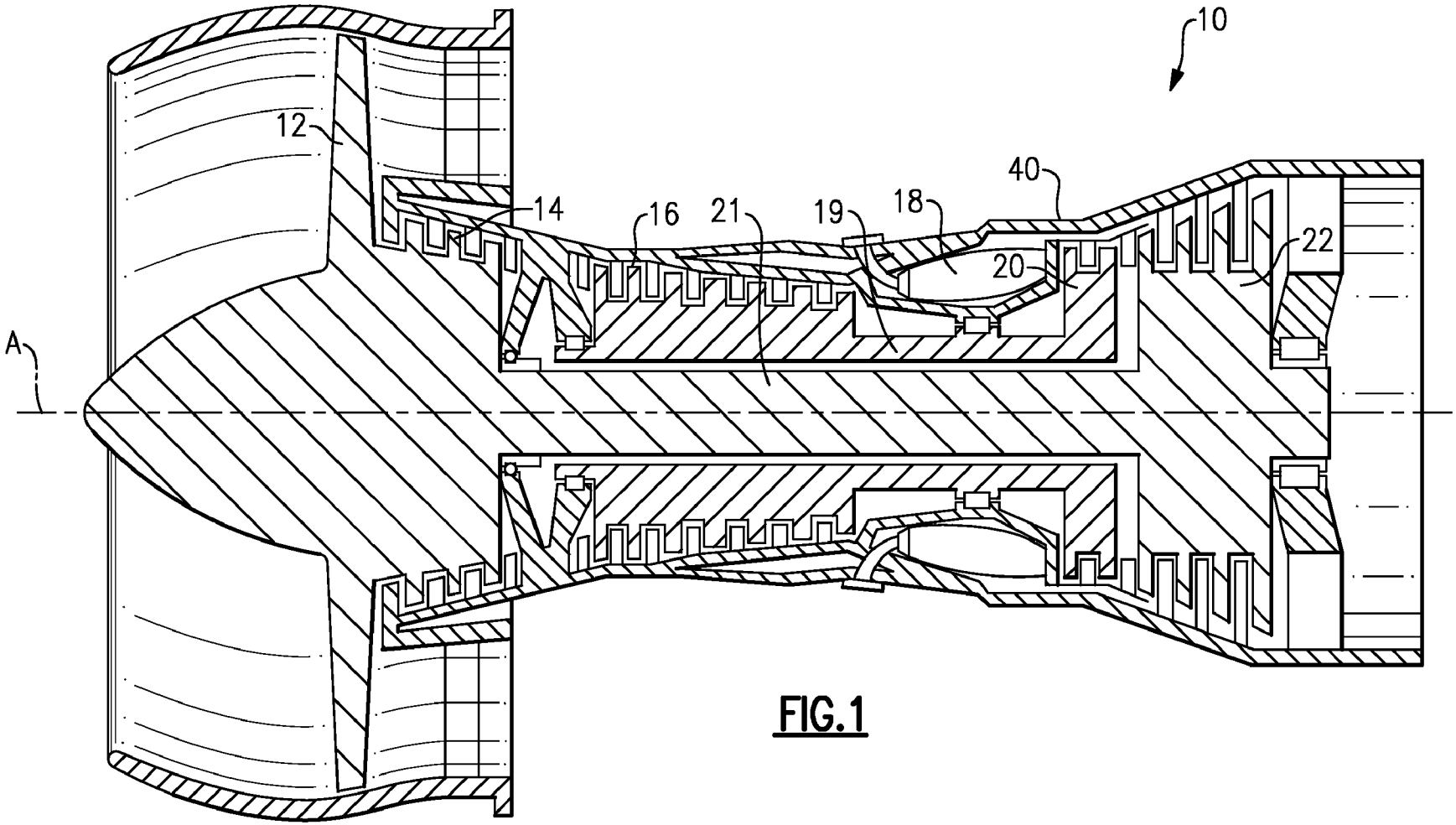
FIG. 1 illustrates a general perspective view of a gas turbine engine.

FIG. 1 illustrates a gas turbine engine 10 which may include (in serial flow communication) a fan section 12, a low pressure compressor 14, a high pressure compressor 16, a combustor 18, a high pressure turbine 20 and a low pressure turbine 22. During operation, air is pulled into the gas turbine engine 10 by the fan section 12, is pressurized by the compressors 14, 16, and is mixed with fuel and burned in the combustor 18. Hot combustion gases generated within the combustor 18 flow through the high and low pressure turbines 20, 22, which extract energy from the hot combustion gases. In a two spool design, the high pressure turbine 20 utilizes the extracted energy from the hot combustion gases to power the high pressure compressor 16 through a high speed shaft 19, and a low pressure turbine 22 utilizes the energy extracted from the hot combustion gases to power the fan section 12 and the low pressure compressor 14 through a low speed shaft 21. However, this invention is not limited to the two spool gas turbine architecture described and may be used with other architectures such as single spool axial designs, a three spool axial design and other architectures. That is, the present invention is applicable to any gas turbine engine, and for any application.

FIG. 2 illustrates a portion of compressor sections 14, 16 which includes multiple compression stages. Each compression stage includes a row of stator vanes 24 (stationary airfoils) followed by a row of rotor blades 26 (moving airfoils). The compression stages are circumferentially disposed about an engine centerline axis A. Although only three compression stages are shown, the actual compressor sections 14, 16 could include any number of compression stages.

The compressor sections 14, 16 also include multiple disks 28 which rotate about engine centerline axis A to rotate the rotor blades 26. Each disk 28 includes a disk rim 30. Each disk rim supports a plurality of rotor blades 26. A seal member, such as a rotor seal land 32, extends from each disk rim 30 between adjacent disk rims 30 of adjacent rows of rotor blades 26.

In one example, the stator vanes 24 are cantilevered stator vanes. That is, the stator vanes 24 are fixed to an engine casing 40 or other structure at their radial outward end 34 and are unsupported at a radial inward end 36. The radial inward end 36 is directly opposite of the radial outward end 34. An airfoil 25 extends between the opposite ends 34, 36. A tip 38 of the radial inward end 36 of each stator 24 extends adjacent to a rotor seal land 32 which extends between adjacent disk rims 30. The radial outward end 34 is mounted to the engine casing 40 which surrounds the compressor section 14, 16, the combustor section 18, and the turbine sections 20, 22. The tip 38 of each stator 24 may contact the rotor seal land 32 to limit re-circulation of airflow within the compressor.

Referring to FIG. 3, a clearance X extends in the open space between the tip 38 of each stator 24 and an exterior surface 44 of the rotor seal lands 32. It should be understood that the clearance X is shown significantly larger than actual to better illustrate the interaction between the stator vanes 24 and the rotor seal lands 32. In one example, the clearance X defined between the stator vanes 24 and the rotor seal lands 32 is as close as is possible to zero (i.e., the stator vanes 24 are in perfect contact with the rotor seal lands 32). A worker of ordinary skill in the art having the benefit of this disclosure would be able to design an appropriate clearance X between the stator vanes 24 and the rotor seal lands 32 to achieve maximum efficiency of the gas turbine engine 10.

The tips 38 of the stator vanes 24 are coated with an abradable material 42. Therefore, the tips 38 are more abradable than the remaining portions of the stator vanes 24 (i.e., the base metal of the stator vanes 24 is less abradable than the abradable material 42). Correspondingly, the exterior surface 44 of each rotor seal land 32 is coated with an abrasive material 46. The abradable material 42 is designed to deteriorate when subjected to friction and the abrasive material 46 is designed to cause irritation to the abradable material 42. Therefore, the abrasive material 46 deteriorates at a slower rate than the abradable material 42. The actual thickness of the coatings of the abradable material 42 and the abrasive material 46 will vary based upon design specific parameters including but not limited to the size and type of the gas turbine engine 10.

In one example, the abrasive material 46 is Cubic Boron Nitride. In another example, the abrasive material is Zirconium Oxide. The Zirconium Oxide may be a Yttria stabilized Zirconium. In one example, the Yttria stabilized Zirconium includes Zirc Oxide stabilized with about 11-14% Yttria. In another example, the Yttria stabilized Zirconium includes Zirc Oxide stabilized with about 6-8% Yttria. In still another example, the stabilized Zirconium Oxide includes Zirc Oxide stabilized with about 18.5-21.5% Yttria. The term "about" as used in this description relative to the compositions refers to possible variations in the compositional percentages, such as normally accepted variations or tolerances in the art. In yet another example, the abrasive material is Aluminum Oxide.

The abradable material 42 includes Zirconium Oxide, in one example. In another example, the abradable material 42 includes the Yttria stabilized Zirconium. It should be understood that other materials may be utilized for the abradable material 42 and the abrasive material 46. A person of ordinary skill in the art having the benefit of this disclosure would be able to select appropriate materials for use as the abradable material 42 and the abrasive material 46. As can be appreciated by those of skill in the art, the Zirconium Oxide is capable of use both as the abrasive material 46 and the abradable material 42. The Zirconium Oxide (i.e., the abrasive material 46) applied to the rotor seal land 32 will abrade the Zirconium Oxide (i.e., the abradable material 42) applied to the tips 38 of the stator vanes 24 in this example.

In one example, the abradable material 42 and the abrasive material 46 are applied by thermal spray. In another example, where the abrasive material 46 includes Cubic Boron Nitride, the abrasive material 46 is applied by a electroplating. Other application methods are also contemplated as within the scope of the present invention.

Use of the abradable material 42 on the tip 38 of each stator 24 and the abrasive material 46 on the rotor seal lands 32 allows the clearance X defined between the stator vanes 24 and the rotor seal lands 32 to be reduced. During operation of the gas turbine engine 10, the components of the gas turbine engine 10 may experience thermal expansion, centrifugal loading, and high maneuver loads during high angle of attack, takeoff and landing flight conditions. The stator vanes 24 may rub against the rotor seal lands 32 while experiencing conditions of this type. During this rub interaction, the abradable material 42 of the stator vanes 24 rubs against the abrasive material 46 applied on the rotor seal lands 32 causing a portion of the abradable material to turn to harmless fine dust.

Minimal heat is generated during the rub interaction between the stator vanes 24 and the rotor seal lands 32. The tighter clearances between the stator vanes 24 and the rotor seal lands 32 reduce the recirculation of airflow within the gas turbine engine thereby improving efficiency and component stability. In one example, the stator vanes 24 are in perfect contact (i.e., line to line contact) with the rotor seal lands 32 during engine operation (See FIG. 4) to achieve maximum efficiency of the gas turbine engine 10. In addition, the abradable material 42 coated onto the tips 38 of the stator vanes 24 provides a thermal barrier effect which protects the base metal of the stator vanes 24 from damaging heat. Therefore, the gas turbine engine 10 may be operated at higher temperatures with a reduced risk of damage.

Although the example components including the abradable and abrasive coatings as illustrated herein are disclosed in association with a compressor section of the gas turbine engine, it should be understood that any other adjacent components of a gas turbine engine, including but not limited to turbine stator vanes and components with slider seal type engagements, may include the abradable and abrasive materials to provide tighter clearances and improved rub interactions between the adjacent components at those tighter clearances. That is, the invention is no limited to compressor stator vanes and is applicable to any gas turbine engine component.

The foregoing description shall be interpreted as illustrative and not in any limiting sense. A worker of ordinary skill in the art would recognize that certain modifications would come within the scope of this invention. For that reason, the following claims should be studied to determine the true scope and content of this invention.

What is claimed is:

1. A gas turbine engine component, comprising:

a compressor stator vane having a radial outward end and a radial inward end;

a rotor seal land adjacent to said radial inward end of said compressor stator vane, wherein a tip of said radial inward end of said compressor stator vane is coated with an abradable material and said rotor seal land is coated with an abrasive material; and wherein said abradable material and said abrasive material are composed of the same material.

2. The component as recited in claim 1, wherein said compressor stator vane is fixed at said radial outward end and unsupported at said radial inward end.

3. The component as recited in claim 1, wherein said abradable material includes zirconium oxide.

4. The component as recited in claim 3, wherein said zirconium oxide includes Yttria stabilized zirconium.

5. The component as recited in claim 4, wherein said Yttria stabilized zirconium includes about 11% to about 14% Yttria.

6. The component as recited in claim 4, wherein said Yttria stabilized zirconium includes about 6% to about 8% Yttria.

7. The component as recited in claim 4, wherein said Yttria stabilized zirconium includes about 18.5% to about 21.5% Yttria.

8. The component as recited in claim 1, wherein said abrasive material includes at least one of Cubic Boron Nitride, Zirconium Oxide and Aluminum Oxide.

9. The component as recited in claim 1, wherein the base metal of the component is less abradable than the coating of said abradable material.

10. The component as recited in claim 1, wherein said compressor stator vane is in line to line contact with said rotor seal land.

11. A gas turbine engine, comprising:

an engine casing extending circumferentially about an engine centerline axis;

a compressor section, a combustor section and a turbine section within said engine casing; wherein at least one of said compressor section and said turbine section includes at least one airfoil and at least one seal member adjacent to said at least one airfoil, wherein a tip of said at least one airfoil is coated with an abradable material and said at least one seal member is coated with an abrasive material; and wherein said abradable material and said abrasive material are composed of the same material .

12. The gas turbine engine as recited in claim 11, wherein said at least one airfoil includes a compressor stator vane.

13. The gas turbine engine as recited in claim 11, wherein said at least one airfoil includes a plurality of compressor stator vanes circumferentially disposed about said engine centerline axis between each of a plurality of rows of rotating rotor blades.

14. The gas turbine engine as recited in claim 13, wherein said at least one seal member includes a plurality of rotor seal lands, wherein one of said plurality of rotor seal lands extends between each of said plurality of rows of rotating rotor blades.

15. The gas turbine engine as recited in claim 11, wherein said at least one airfoil is mounted at a radial outward end to said engine casing and said tip of said at least one airfoil is positioned at an opposite end of said at least one airfoil from said radial outward end.

16. The gas turbine engine as recited in claim 11, wherein said abradable material includes zirconium oxide.

17. The gas turbine engine as recited in claim 11, wherein said abradable material includes Yttria stabilized Zirconium.

18. The gas turbine engine as recited in claim 11, wherein said abrasive material includes at least one of cubic boron nitride, zirconium oxide and aluminum oxide.

19. The gas turbine engine as recited in claim 11, wherein the base metal of said at least one airfoil is less abradable than the coating of said abradable material.

20. The gas turbine engine as recited in claim 11, wherein said at least one airfoil is in line to line contact with said at least one seal member.

* * * * *